US010102958B2

(12) United States Patent
Shudarek et al.

(10) Patent No.: US 10,102,958 B2
(45) Date of Patent: Oct. 16, 2018

(54) METHODS OF MANUFACTURE OF INDUCTORS HAVING ENHANCED COOLING AND USE THEREOF

(71) Applicant: MTE Corporation, Menomonee Falls, WI (US)

(72) Inventors: Todd A. Shudarek, West Bend, WI (US); Daniel Paddock, Waukesha, WI (US)

(73) Assignee: MTE Corporation, Menomonee Falls, WI (US)

( * ) Notice: Subject to any disclaimer, the term of this patent is extended or adjusted under 35 U.S.C. 154(b) by 0 days.

(21) Appl. No.: 15/626,976

(22) Filed: Jun. 19, 2017

(65) Prior Publication Data

US 2017/0365391 A1 Dec. 21, 2017

Related U.S. Application Data

(60) Provisional application No. 62/351,791, filed on Jun. 17, 2016.

(51) Int. Cl.

| | |
|---|---|
| ***H01F 27/32*** | (2006.01) |
| ***H01F 27/08*** | (2006.01) |
| ***H01F 27/24*** | (2006.01) |
| ***H01F 27/28*** | (2006.01) |

(52) U.S. Cl.

CPC ..... *H01F 27/085* (2013.01); *H01F 27/24* (2013.01); *H01F 27/2828* (2013.01); *H01F 27/2876* (2013.01); *H01F 27/32* (2013.01)

(58) Field of Classification Search

CPC ..... H01F 27/00–27/36
USPC ..... 336/55–62
See application file for complete search history.

(56) References Cited

U.S. PATENT DOCUMENTS

| | | | |
|---|---|---|---|
| 5,138,294 | A | 8/1992 | Yoshikawa |
| 6,226,314 | B1 | 5/2001 | Bruckner et al. |
| 2009/0261939 | A1 | 10/2009 | Shudarek |
| 2013/0188298 | A1 | 7/2013 | Srikantaiah et al. |

OTHER PUBLICATIONS

International Search Report and Written Opinion for PCT Application No. PCT/US2017/038161, dated Aug. 31, 2017.

*Primary Examiner* — Tuyen Nguyen
(74) *Attorney, Agent, or Firm* — Greenberg Traurig, LLP

(57) ABSTRACT

In some embodiments, the instant invention can provide an electrical system that includes: a three-phase inductor with a core, including: a first segment having a first coil arrangement; a second segment having a second coil arrangement; a third segment having a third coil arrangement; where each of the first coil arrangement, the second coil arrangement, and the third coil arrangement has at least one air duct; at least one air baffle; and where the at least one air baffle is configured to be operationally attached to at least one selected coil arrangement in a position which allows the at least one air baffle to extend from at least one surface of the at least one selected coil arrangement into a flow of a supplied air.

10 Claims, 7 Drawing Sheets

METHODS OF MANUFACTURE OF INDUCTORS HAVING ENHANCED COOLING AND USE THEREOF

RELATED APPLICATIONS

This application claims priority of U.S. Provisional Appln. No. 62/351,791, filed Jun. 17, 2016, entitled "METHODS OF MANUFACTURE OF ADJUSTABLE INTEGRATED COMBINED COMMON MODE AND DIFFERENTIAL MODE THREE PHASE INDUCTORS AND USE THEREOF," which is incorporated herein by reference in its entirety for all purposes.

TECHNICAL FIELD

In some embodiments, the instant invention relates to inductors and methods of manufacture and use thereof.

BACKGROUND

Typically, a three phase inductor has both common mode and differential mode magnetic flux paths that overlap and circulate around the center of the core construction. Typically, a three phase inductor is constructed from three core segments.

SUMMARY OF INVENTION

In some embodiments, the instant invention can provide an electrical system that at least includes the following: a three-phase inductor that at least includes: a core, including: a first segment having a first coil arrangement; a second segment having a second coil arrangement; a third segment having a third coil arrangement; where each of the first coil arrangement, the second coil arrangement, and the third coil arrangement has at least one air duct; where the at least one air duct is configured to allow a supplied air that is supplied to the core to pass through the at least one air duct to reduce an operational temperature of a respective coil arrangement; at least one air baffle; where the at least one air baffle is configured to be operationally attached to at least one selected coil arrangement in a position which allows the at least one air baffle to extend from at least one surface of the at least one selected coil arrangement into a flow of the supplied air so as to direct at least a portion of the supplied air into at least one respective air duct of the at least one selected coil arrangement to reduce the operational temperature of the respective coil arrangement; and where the at least one selected coil arrangement is at least one of the first coil arrangement, the second coil arrangement, and the third coil arrangement.

In some embodiments, the at least one air baffle is constructed from an insulation material.

In some embodiments, the insulation material is at least partially made from at least one of Glastic material and Nomex-based material.

In some embodiments, the at least one air baffle has a thickness of at least 0.010 inch.

In some embodiments, at least one dimension of the at least one air baffle varies from 2.00 inches to 20.00 inches.

In some embodiments, the at least one air baffle is configured to be operationally attached to the at least one selected coil arrangement in the position which is substantially parallel to an outer surface of the at least one selected coil arrangement in a longitudinal axis.

In some embodiments, the at least one air baffle is configured to be directly attached to the at least one selected coil arrangement via at least one bracket.

In some embodiments, the at least one air baffle is configured to have a shape configured to affect an amount of the portion of the supplied air being directed into the at least one respective air duct of the at least one selected coil arrangement.

In some embodiments, where the at least one air baffle is a first air baffle; where the core further includes a second air baffle; where the first air baffle is configured to be operationally attached to a first selected coil arrangement; where the second air baffle is configured to be operationally attached to a second selected coil arrangement; and where the first selected coil arrangement is distinct from the second selected coil arrangement.

In some embodiments, where the first air baffle has a first shape; where the second air baffle has a second shape; and where the first shape is distinct from the second shape.

BRIEF DESCRIPTION OF THE DRAWINGS

The present invention will be further explained with reference to the attached drawings, wherein like structures are referred to by like numerals throughout the several views. The drawings shown are not necessarily to scale, with emphasis instead generally being placed upon illustrating the principles of the present invention. Further, some features may be exaggerated to show details of particular components.

Figure 1:
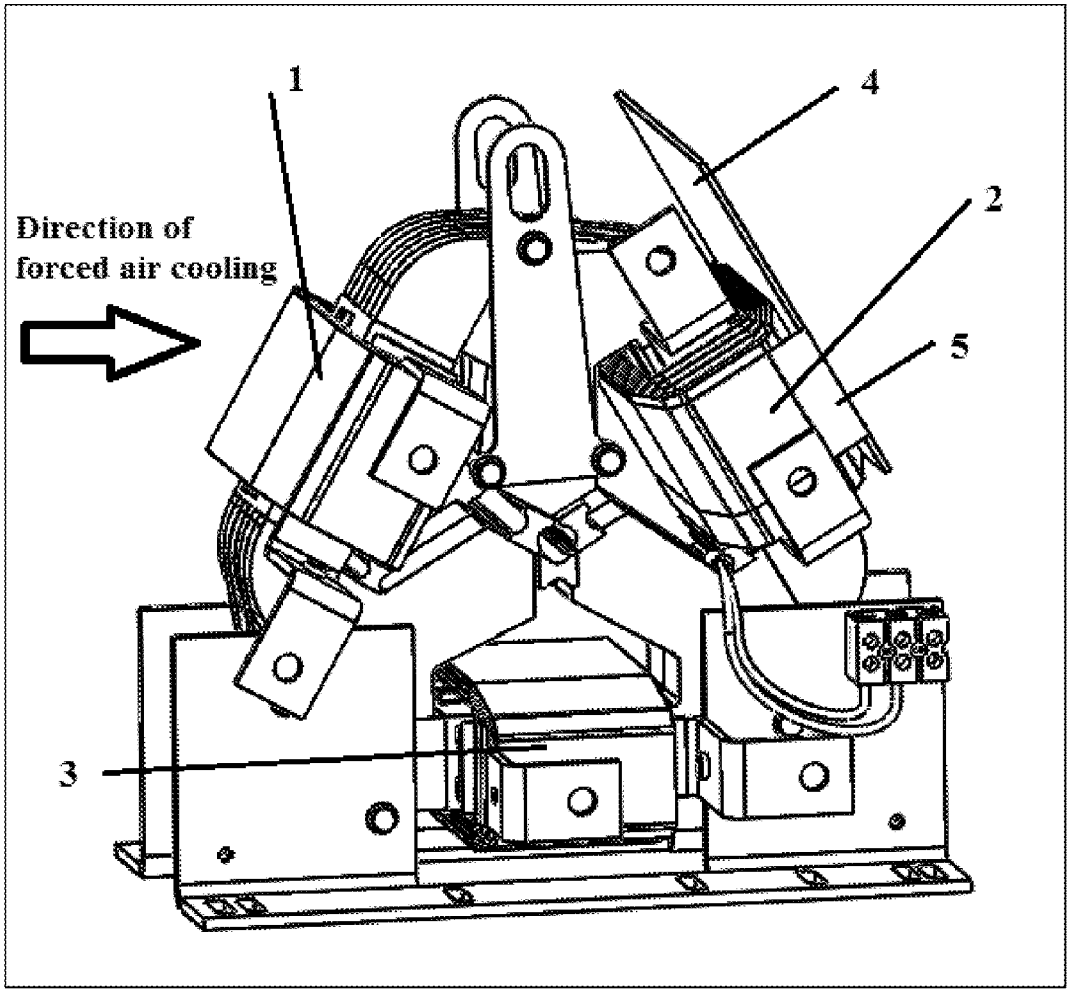
FIGS. 1-7 are snapshots that illustrate certain aspects of the instant invention in accordance with some embodiments of the instant invention.

The figures constitute a part of this specification and include illustrative embodiments of the present invention and illustrate various objects and features thereof. Further, the figures are not necessarily to scale, some features may be exaggerated to show details of particular components. In addition, any measurements, specifications and the like shown in the figures are intended to be illustrative, and not restrictive. Therefore, specific structural and functional details disclosed herein are not to be interpreted as limiting, but merely as a representative basis for teaching one skilled in the art to variously employ the present invention.

DETAILED DESCRIPTION OF SOME EMBODIMENTS

Detailed embodiments of the present invention are disclosed herein; however, it is to be understood that the disclosed embodiments are merely illustrative of the invention that may be embodied in various forms. In addition, each of the examples given in connection with the various embodiments of the invention which are intended to be illustrative, and not restrictive. Any alterations and further modifications of the inventive feature illustrated herein, and any additional applications of the principles of the invention as illustrated herein, which would normally occur to one skilled in the relevant art and having possession of this disclosure, are to be considered within the scope of the invention.

Throughout the specification and claims, the following terms take the meanings explicitly associated herein, unless the context clearly dictates otherwise. The phrases "in one embodiment" and "in some embodiments" as used herein do not necessarily refer to the same embodiment(s), though it may. Furthermore, the phrases "in another embodiment" and "in some other embodiments" as used herein do not necessarily refer to a different embodiment, although it may. Thus, as described below, various embodiments of the invention may be readily combined, without departing from the scope or spirit of the invention.

In addition, as used herein, the term "or" is an inclusive "or" operator, and is equivalent to the term "and/or," unless the context clearly dictates otherwise. The term "based on" is not exclusive and allows for being based on additional factors not described, unless the context clearly dictates otherwise. In addition, throughout the specification, the meaning of "a," "an," and "the" include plural references. The meaning of "in" includes "in" and "on."

As used herein, "high permeability" means a magnetic permeability that is at least 1000 times greater than the permeability of air, and "low permeability" means a magnetic permeability that is less than 100 times the permeability of air.

In some embodiments, the present invention is directed to devices having at least one inductor core, being constructed as an integrated common mode/differential mode three phase inductor core with adjustable differential mode inductance and increased common mode inductance.

In some embodiments, in accordance with the present invention each core shape and each method of construction of such core described in, for example, but not limited to, U.S. Pat. No. 9,613,745, to Shudarek ("Shudarek 745"), U.S. Pat. No. 7,768,373, to Shudarek ("Shudarek 373"), and U.S. patent application Ser. No. 15,487,910, to Shudarek ("Shudarek 910"), entitled "ADJUSTABLE INTEGRATED COMBINED COMMON MODE AND DIFFERENTIAL MODE THREE PHASE INDUCTORS WITH INCREASED COMMON MODE INDUCTANCE AND METHODS OF MANUFACTURE AND USE THEREOF," all are hereby incorporate herein for all purposes, can be constructed with a particular positioning of at least one baffle configured to have a particular shape and size, where the location of each baffle, its shape, size and/or thickness can be configured to reduce the operational temperature and/or cost of the manufactured parts.

FIG. 1 shows a schematic arrangement during an exemplary manufacturing process in accordance with some embodiments of the present invention. For example, in FIG. 1, forced air cooling is coming from the left side of the inductor as shown by an arrow. Each of three coils arrangements 1, 2 and 3 of an exemplary inventive inductor contains at least one air duct. For example, an exemplary inventive baffle of the present invention, 4, is attached, directly or indirectly (i.e., operationally attached), to the far coil arrangement, 2, to direct air down the air duct(s) to reduce an operational temperature of the coil arrangement 2. In some embodiments, the exemplary inventive baffle could be, but not limited to, wound into the coil before the last layer or secured with tape wrapped around the coil arrangement.

In some embodiments, the exemplary inventive baffle, 4, can be constructed from various sufficiently suitable materials that may be included as part of insulation systems such as, but not limited to, Glastic™ material(s) (Röchling Glastic Composites, Cleveland, Ohio) or Nomex-based material(s). In some embodiments, depending on the material being used to manufacture, the exemplary inventive baffle, 4, may need to have at least a minimum thickness of at least 0.010 inch. In some embodiments, the dimension(s) of the exemplary inventive baffle, 4, can vary from 2.00 inches to 20.00 inches in one or more dimensions. In some embodiments, the exemplary inventive baffle, 4, can also be constructed from an insulated piece of metal. In some embodiments, the exemplary inventive baffle, 4, can be positioned above the coil arrangement, 2, substantially parallel to an outer surface of the coil arrangement in a longitudinal axis.

Figure 2:
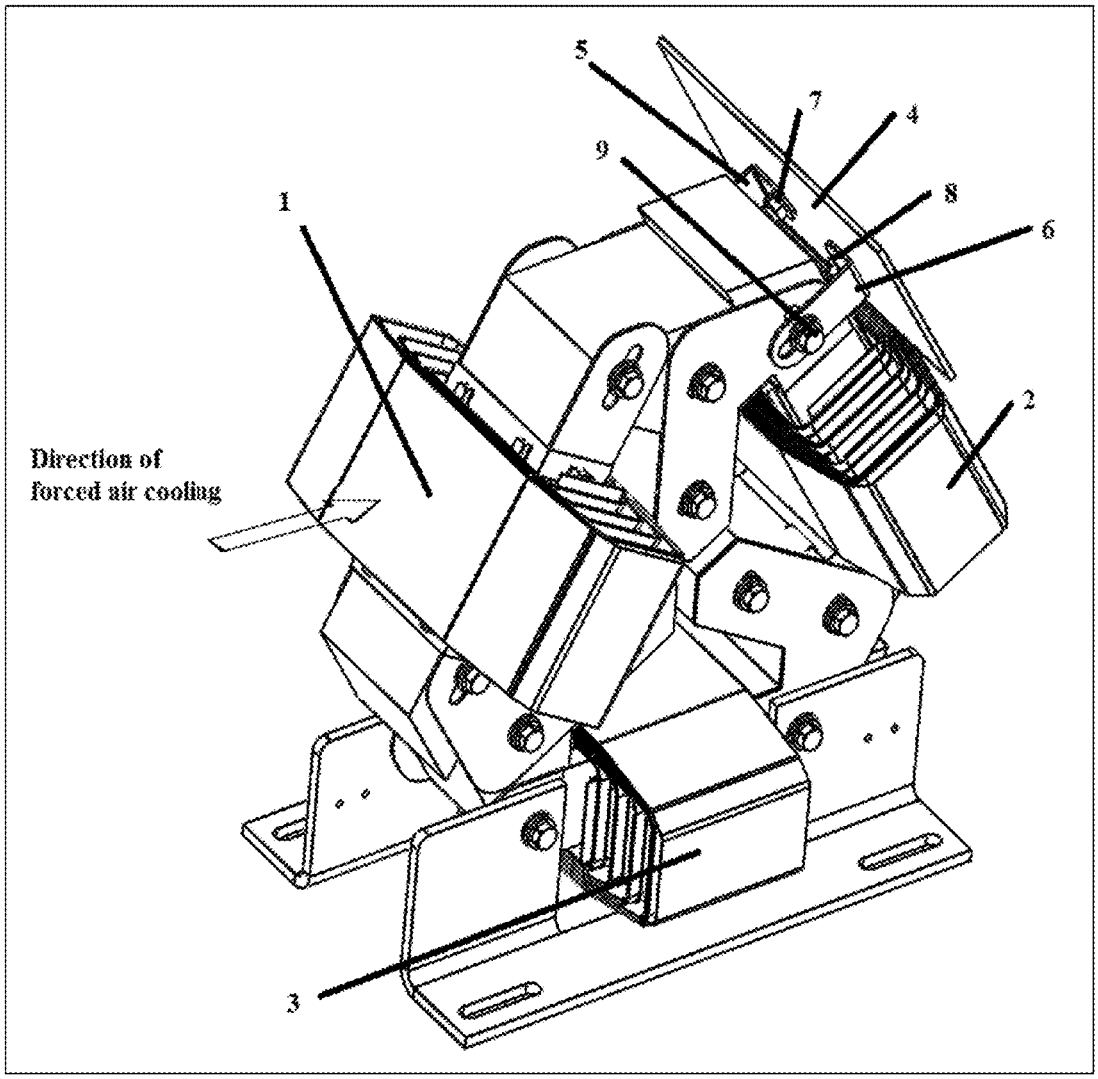

FIG. 2 shows another schematic arrangement during another exemplary manufacturing process in accordance with some embodiments of the present invention. For example, in FIG. 2, the forced air cooling is coming from the left side of the inductor as shown by an arrow. Each of three coils arrangements 1, 2, 3 of another exemplary inventive inductor contains at least one air duct. For example, another exemplary inventive baffle of the present invention, 4, is attached, directly or indirectly, to the core with brackets 6 and 7 with the associated hardware 7, 8 and 9. In some embodiments, the exemplary inventive baffle in FIG. 2 is configured to direct air down the air duct(s) to reduce the operational temperature of the coil arrangement 2. In some embodiments, the number of brackets can vary (e.g., 1, 2, etc.).

In some embodiments, the exemplary inventive baffle, 4, can be constructed from various sufficiently suitable materials that may be included as part of insulation systems such as, but not limited to, Glastic™ material(s) (Röchling Glastic Composites, Cleveland, Ohio) or Nomex-based material(s). In some embodiments, the exemplary inventive baffle, 4, can also be constructed from an insulated piece of metal such as, but not limited to, steel. In some embodiments, the exemplary inventive baffle, 4, can be positioned above the coil arrangement, 2, substantially parallel to the coil outer surface.

Figure 3:
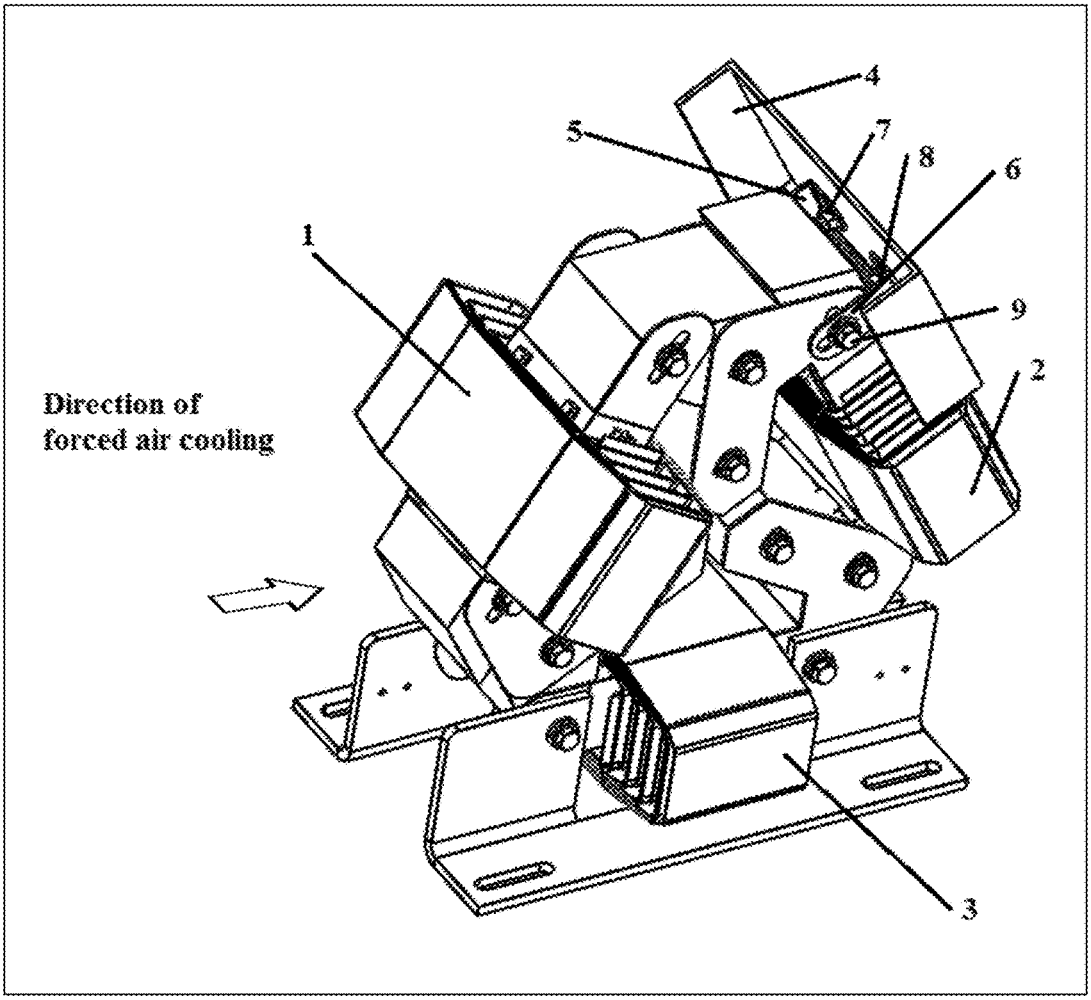

FIG. 3 shows yet another schematic arrangement during yet another exemplary manufacturing process in accordance with some embodiments of the present invention. For example, in FIG. 3, the forced air cooling is coming from the left side of the inductor as shown by an arrow. Each of three coils arrangements 1, 2, 3 of yet another exemplary inventive inductor contains at least one air duct. For example, yet another exemplary inventive baffle of the present invention, 4, is attached, directly or indirectly, to the core with brackets 6 and 7 with the associated hardware 7, 8 and 9. In some embodiments, the exemplary inventive baffle in FIG. 3 is configured to direct air down the air duct(s) to reduce the operational temperature of the coil arrangement 2. In some embodiments, the number of brackets can vary (e.g., 1, 2, etc.).

In some embodiments, the exemplary inventive baffle, 4, can be formed, for example, with two, but not limited to, bends as shown, and can be constructed from various sufficiently suitable materials that may be included as part of insulation systems such as, but not limited to, Glastic™ material(s) (Röchling Glastic Composites, Cleveland, Ohio). In some embodiments, the exemplary inventive baffle, 4, can also be constructed from an insulated piece of metal such as, but not limited to, steel. In some embodiments, the exemplary inventive baffle, 4, can be positioned above the coil arrangement, 2, with the center surface of the exemplary inventive baffle, 4, substantially parallel to the coil outer surface. In some embodiments, an additional bent section of the exemplary inventive baffle, 4, is specifically configured to, for example, direct more air into the coil duct(s) to increase cooling effectiveness.

Figure 4:
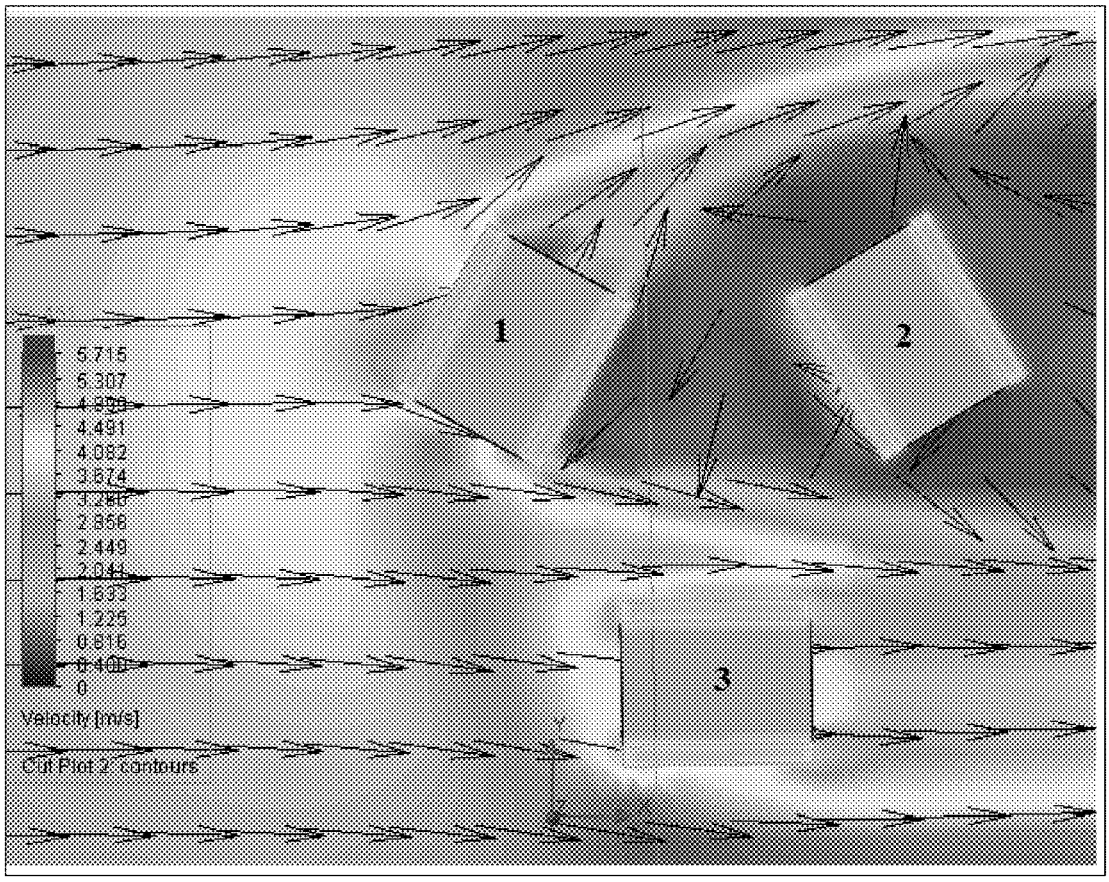
Figure 5:
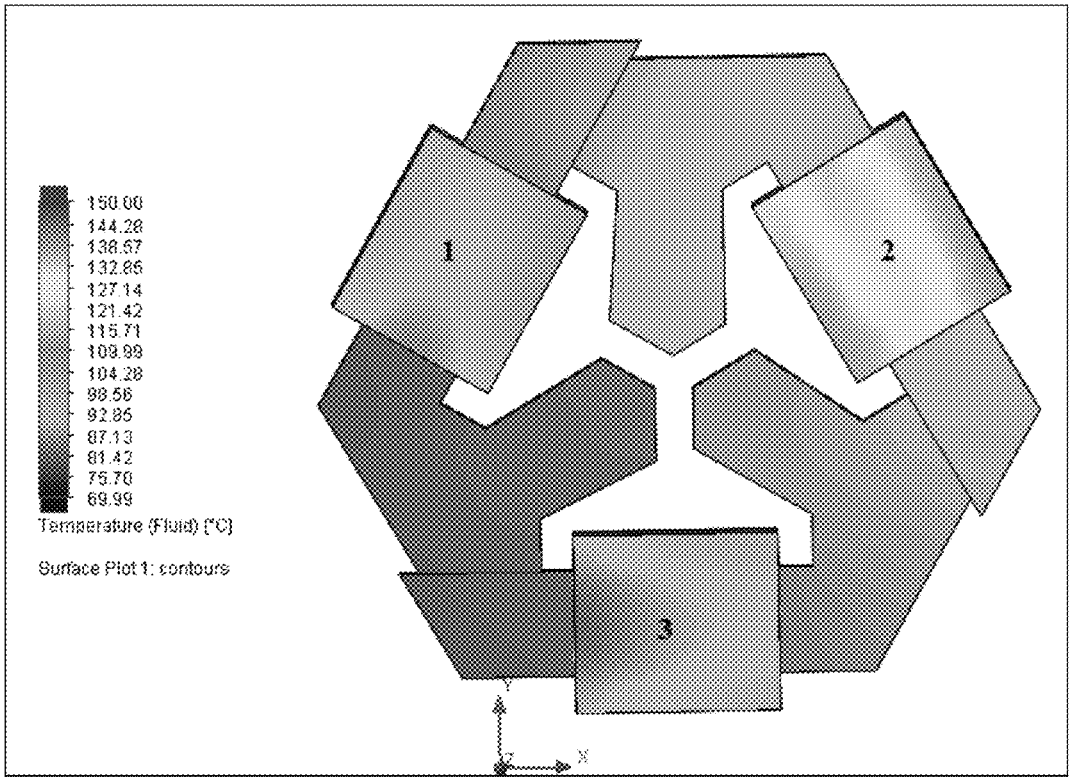

FIG. 4 shows an example of the simulated air velocities through the coils without the exemplary inventive air baffle. For example, the coil arrangement 1 has suitably adequate air flow through the air ducts directed in from the bottom of the coil, then force upward at about a 45 degree angle. For example, the coil arrangement 3's air ducts are in line with the direction of the forced air cooling. For example, the coil arrangement 2 has a little air flow through the duct(s) so it would operate significantly hotter. For example, the associated operational temperatures of the coils arrangements (1, 2 and 3) are shown in FIG. 5. For example, the coil arrangement 2 can operate about 40 degrees hotter than the other two coils.

Figure 6:
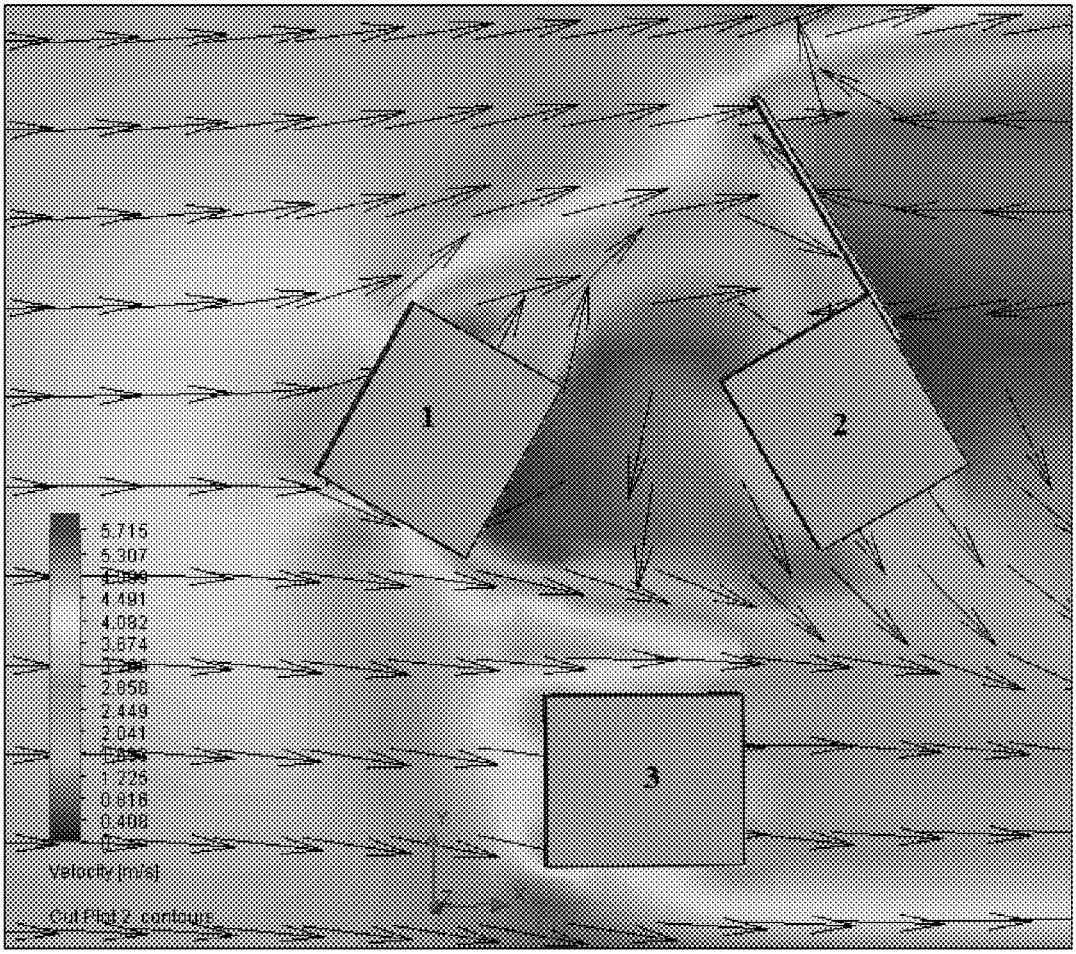
Figure 7:
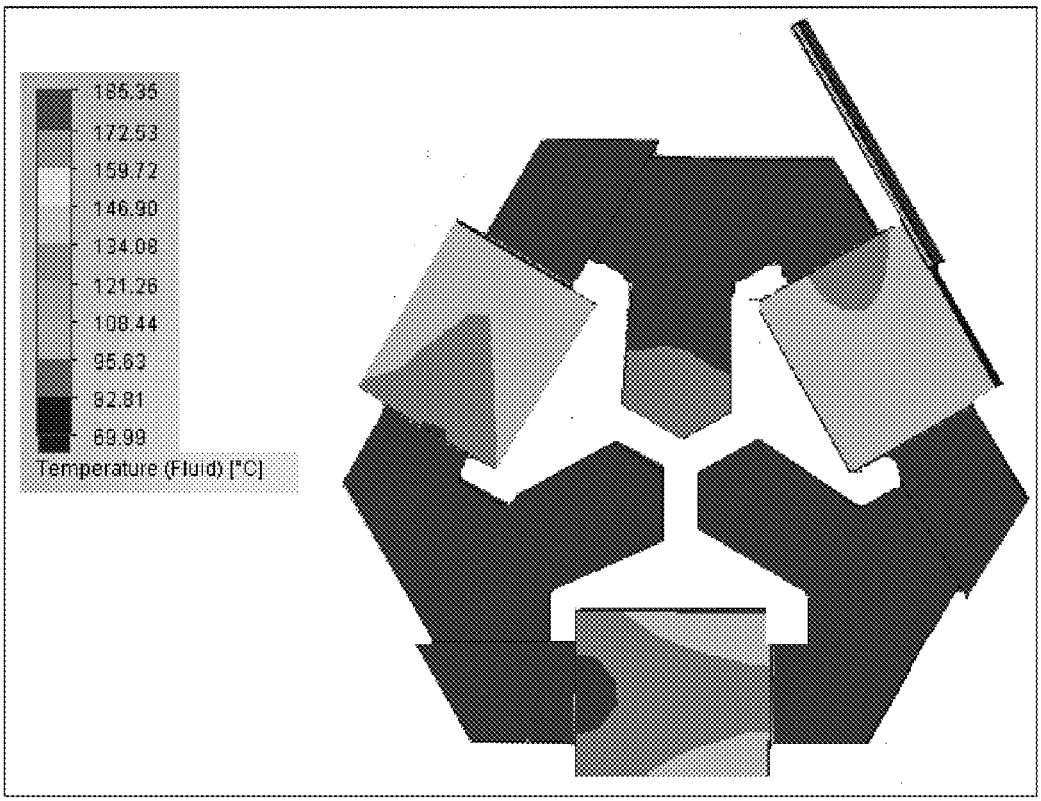

FIG. 6 shows an example of the simulated air velocities through the coil arrangements with at least one exemplary inventive air baffle as, for example, shown in FIGS. 1-3. For example, the coil arrangement 1 has adequate air flow through the air ducts directed in from the bottom of the coil, then force upward at about a 60 degree angle. For example, the coil arrangement 3's air ducts are in line with the direction of the forced air cooling. For example, the coil arrangement 2 has suitably adequate air flow through the ducts directed downward at a 60 degree angle so it can operate at similar operational temperatures to the coil arrangements 1 and 3. The associated simulated operational temperatures of the coils in accordance with some embodiments of the present invention are shown in FIG. 7. For example, as shown in FIG. 7, all of the coil arrangements can operate at substantially similar and/or uniform cooler operational temperatures than, for example but not limited to, the operational temperatures identified in FIG. 5.

In some embodiments, each of coil arrangement detailed herein can be a bobbin-type coil arrangement.

In some embodiments, the instant invention can provide an electrical system that at least includes the following: a three-phase inductor that at least includes: a core, including: a first segment having a first coil arrangement; a second segment having a second coil arrangement; a third segment having a third coil arrangement; where each of the first coil arrangement, the second coil arrangement, and the third coil arrangement has at least one air duct; where the at least one air duct is configured to allow a supplied air that is supplied to the core to pass through the at least one air duct to reduce an operational temperature of a respective coil arrangement; at least one air baffle; where the at least one air baffle is configured to be operationally attached to at least one selected coil arrangement in a position which allows the at least one air baffle to extend from at least one surface of the at least one selected coil arrangement into a flow of the supplied air so as to direct at least a portion of the supplied air into at least one respective air duct of the at least one selected coil arrangement to reduce the operational temperature of the respective coil arrangement; and where the at least one selected coil arrangement is at least one of the first coil arrangement, the second coil arrangement, and the third coil arrangement.

In some embodiments, the at least one air baffle is constructed from an insulation material.

In some embodiments, the insulation material is at least partially made from at least one of Glastic material and Nomex-based material.

In some embodiments, the at least one air baffle has a thickness of at least 0.010 inch.

In some embodiments, at least one dimension of the at least one air baffle varies from 2.00 inches to 20.00 inches.

In some embodiments, the at least one air baffle is configured to be operationally attached to the at least one selected coil arrangement in the position which is substantially parallel to an outer surface of the at least one selected coil arrangement in a longitudinal axis.

In some embodiments, the at least one air baffle is configured to be directly attached to the at least one selected coil arrangement via at least one bracket.

In some embodiments, the at least one air baffle is configured to have a shape configured to affect an amount of the portion of the supplied air being directed into the at least one respective air duct of the at least one selected coil arrangement.

In some embodiments, where the at least one air baffle is a first air baffle; where the core further includes a second air baffle; where the first air baffle is configured to be operationally attached to a first selected coil arrangement; where the second air baffle is configured to be operationally attached to a second selected coil arrangement; and where the first selected coil arrangement is distinct from the second selected coil arrangement. In some embodiments, where the first air baffle has a first shape; where the second air baffle has a second shape; and where the first shape is distinct from the second shape.

While a number of embodiments of the present invention have been described, it is understood that these embodiments are illustrative only, and not restrictive, and that many modifications may become apparent to those of ordinary skill in the art.

What is claimed is:

1. An electrical system, comprising:
- a three-phase inductor, comprising:
  - a core, comprising:
    - a first segment having a first coil arrangement;
    - a second segment having a second coil arrangement;
    - a third segment having a third coil arrangement;
      - wherein each of the first coil arrangement, the second coil arrangement, and the third coil arrangement has at least one air duct;
      - wherein the at least one air duct is configured to allow a supplied air that is supplied to the core to pass through the at least one air duct to reduce an operational temperature of a respective coil arrangement;
    - at least one air baffle;
      - wherein the at least one air baffle is configured to be operationally attached to at least one selected coil arrangement in a position which allows the at least one air baffle to extend from at least one surface of the at least one selected coil arrangement into a flow of the supplied air so as to direct at least a portion of the supplied air into at least one respective air duct of the at least one selected coil arrangement to reduce the operational temperature of the respective coil arrangement; and
      - wherein the at least one selected coil arrangement is at least one of the first coil arrangement, the second coil arrangement, and the third coil arrangement.

2. The electrical system of claim 1, wherein the at least one air baffle is constructed from an insulation material.

3. The electrical system of claim 2, wherein the insulation material is at least partially made from at least one of Glastic material and Nomex-based material.

4. The electrical system of claim 1, wherein the at least one air baffle has a thickness of at least 0.010 inch.

5. The electrical system of claim 1, wherein at least one dimension of the at least one air baffle varies from 2.00 inches to 20.00 inches.

6. The electrical system of claim 1, wherein the at least one air baffle is configured to be operationally attached to the at least one selected coil arrangement in the position which is substantially parallel to an outer surface of the at least one selected coil arrangement in a longitudinal axis.

7. The electrical system of claim 1, wherein the at least one air baffle is configured to be directly attached to the at least one selected coil arrangement via at least one bracket.

8. The electrical system of claim 1, wherein the at least one air baffle is configured to have a shape configured to affect an amount of the portion of the supplied air being directed into the at least one respective air duct of the at least one selected coil arrangement.

9. The electrical system of claim 1, wherein the at least one air baffle is a first air baffle;

wherein the core further comprises a second air baffle;

wherein the first air baffle is configured to be operationally attached to a first selected coil arrangement;

wherein the second air baffle is configured to be operationally attached to a second selected coil arrangement; and wherein the first selected coil arrangement is distinct from the second selected coil arrangement.

10. The electrical system of claim 9, wherein the first air baffle has a first shape;

wherein the second air baffle has a second shape; and wherein the first shape is distinct from the second shape.

* * * * *